United States Patent [19]

Koga et al.

[11] Patent Number: 4,727,344

[45] Date of Patent: Feb. 23, 1988

[54] ELECTROMAGNETIC DRIVE AND POLARIZED RELAY

[75] Inventors: Hirofumi Koga, Kyoto; Kozo Maenishi, Nagaokakyo; Shuichi Kashimoto, Kyoto; Sueaki Honda, Uji; Kenichi Tsuruyoshi, Kusatsu; Takezo Sano, Shiga, all of Japan

[73] Assignee: Omron Tateisi Electronics Co., Kyoto, Japan

[21] Appl. No.: 914,521

[22] Filed: Oct. 2, 1986

Related U.S. Application Data

[63] Continuation of Ser. No. 596,717, Apr. 4, 1984, abandoned.

[51] Int. Cl.[4] ..... H01H 51/22

[52] U.S. Cl. ..... 335/78; 335/81; 335/229

[58] Field of Search ..... 335/78–85; 335/229–236

[56] References Cited

U.S. PATENT DOCUMENTS

| | | | |
|---|---|---|---|
| 4,142,166 | 2/1979 | Arnoux | 335/81 |
| 4,563,663 | 1/1986 | Niekawa et al. | 335/78 |

FOREIGN PATENT DOCUMENTS

| | | |
|---|---|---|
| 2728629 | 1/1978 | Fed. Rep. of Germany . |
| 2934558 | 3/1980 | Fed. Rep. of Germany . |
| 3320000 | 1/1984 | Fed. Rep. of Germany . |
| 57-188816 | 11/1982 | Japan . |
| 2030366 | 3/1983 | United Kingdom . |

*Primary Examiner*—Harold Broome

*Attorney, Agent, or Firm*—Schwartz, Jeffery, Schwaab, Mack, Blumenthal & Evans

[57] ABSTRACT

A polarized relay with an electromagnetic drive comprises an electromagnetic yoke composed of a core wound with a coil and a yoke body, and having one end portion of one magnetic polarity and a pair of bifurcated end portions of the other magnetic polarity opposite to the one magnetic polarity. The bifurcated end portions are separated in opposition from each other. The one end portion of the yoke is disposed between the bifurcated end portions so as to cooperate to form a pair of working gaps. A movable block of a substantially C-like configuration incorporating a permanent magnet has two magnetic pole pieces which are disposed within the working gaps, respectively. Guide is provided for guiding the movable block in response to energization and deenergization of the coil so that the pole pieces are movable within the respective working gaps. A contact mechanism including movable contacts is mechanically coupled to the movable block to make or break circuit.

12 Claims, 20 Drawing Figures

ELECTROMAGNETIC DRIVE AND POLARIZED RELAY

This application is a continuation of application Ser. No. 596,717, filed Apr. 4, 1984, now abandoned.

BACKGROUND OF THE INVENTION

1. Field of the Invention

The present invention relates to an electromagnetic drive unit for use in a relay apparatus and a polarized relay of the type in which relay contacts are driven by a movable member or block adapted to be operated through energization of the electromagnetic drive unit.

2. Description of the Prior Art

In a known polarized relay apparatus, the contacts are operated by means of a drive mechanism which comprises such an electromagnetic drive unit or assembly as shown in FIG. 1 of the accompanying drawings. Referring to the figure, the electromagnetic drive assembly is composed of a permanent magnet 1 and a pair of inverted C-like armature plates 2 and 3 between which the permanent magnet 1 is interposed such that the axis of magnetization of the permanent magnet 1 extends perpendicularly to the armature plates 2 and 3. A bar-like iron core 5 would with the coil 4 is disposed between the armature plates 2 and 3 with both ends of the core 5 being positioned in the air gaps defined, respectively, by the opposing end poles of the armature plates 2 and 3. When a current is supplied to the coil 4, the armatures 2 and 3 are rotated about a pivotal shaft 6 in either one of derections indicated by a double-head arrow S depending on the direction of the supplied current, whereby a movable contact plate or piece of a contact mechanism is operated in the direction to open or close the contacts. The prior art electromagnetic relay shown in FIG. 1 however suffers from drawbacks mentioned below. In the present state of technology in the concerned field, the electromagnetic relay tends to be miniaturezed so that it can be mounted on a substrate for a printed circuit. In this connection, it is noted that the whole length of the known electromagnetic drive unit or assembly is necessarily increased due to the fact the air gaps for allowing movement of the armatures 2 and 3 are provided at both ends of the iron core 5 wound with the coil 4. Further, because the coil assembly is disposed as overlying the armature block of a substantial thickness, an increase in height is involved, resulting in a bulky structure which prevents effective miniaturization of the electromagnetic relay. It should further be added that there is a great distance between the permanent magnet 1 and each of the air gaps, giving rise to significant leakage of the magnetic flux and hence low sensitivity of the electromagnetic relay.

As another example of the electromagnetic drive unit for the polarized relay apparatus, there has been known a structure in which an E-like iron core is employed (reference may be made to Japanese Patent Publication No. 30232/1982, by way of example.) According to this prior art, an E-like iron core 7 having three legs *7a, 7b* and *7c* is used, wherein the mid leg *7b* is wound with the coil 4, as is shown in FIG. 2 of the accompanying drawings. A C-like movable element block generally denoted by 12 is constituted by a permanent magnet 9 sandwiched between two pole pieces or plates 10 and 11 with the axis of magnetization of the magnet 9 extending perpendicularly to the pole pieces 10 and 11. The legs or free ends of the pole pieces are, respectively, disposed within air gaps (also referred to as the working gaps) 8 defined by the three legs *7a, 7b* and *7c* of the E-like core 7. When the coil 4 is electrically energized in one direction, the movable element or block 12 is moved to the right as viewed in FIG. 2, to form a closed magnetic circuit. On the other hand, when the coil 4 is supplied with a current in the other direction, the movable block 12 is displeced to the left, whereby the contacts are closed or opened in response to the movement of the block 12 to which the contact mechanism is connected. This electromagnetic assembly is disadvantageous in that width of the assembly is remarkably increased, thus it is difficult to incorporate the electromagnetic relay in electronic and electric apparatus which are increasingly required to be implemented in a miniature size. Such large width may be explained by the fact that, assuming the required magnetic path cross-sectional area of the center leg *7b* wound with the coil 4 to be represented by a, the total cross-sectional areas of three legs *7a, 7b* and *7c* amounts to 3X a. The lateral dimension or width of the electromagnetic drive assembly is therefore enlarged, which is further compounded by the necessity of provision of the working air gap 8 which encloses the coil 4.

SUMMARY OF THE INVENTION

It is therefore an object of the present invention to provide an improved electromagnetic drive apparatus for a polarized relay which is immune to the disadvantages of the known electromagnetic drive and suited to be implemented in a miniature size.

Another object of the present invention is to provide a polarized relay which is equiped with a miniaturized electromagnetic drive for operating relay contacts and exhibits a high sensitivity.

Still another object of the present invention is to provide an electromagnetic drive apparatus which can be used for a polarized relay either of latching type or monostable type.

A further object of the present invention is to provide an electromagnetic relay apparatus of an improved structure in which a coil spool assembly constituting a main part of the electromagnetic drive apparatus can be offhand secured to a terminal-pin (post) carrying base plate through a single stroke of operation in a much simplified manner.

In view of the objects mentioned above, the present invention is characterized in that a yoke structure for the electromagnetic drive assembly is miniaturized. More particularly, an iron core wound with a coil is so disposed as to extend substantially in parallel with a yoke body to constitute a yoke, wherein one end portion of the yoke is bifurcated into two end portions between which the other end of the yoke, i.e. end portion of the iron core is disposed to thereby define air gaps (working gaps) through cooperation with the bifurcated end portions mentioned above. A movable block constituted by a permanent magnet disposed between a pair of side pole pieces or plates is so disposed that the pole plates are movably positioned in the air gaps, respectively. The iron core and the yoke body may be vertically juxtaposed in parallel or horizontally juxtaposed. In either case, the yoke has a pair of legs constituted by the core and the yoke body, respectively.

With the structure of the electromagnetic drive according to the invention, the working air gaps are provided only at one end of the electromagnetic drive. Thus, the overall length of the electromagnetic drive can be significantly decreased. Further, because the armature constituted in part by the movable block is positioned only at one end of the coil, the height of the electromagnetic drive can also be reduced. Moreover, since the end of the core and the bifurcated end portions of the yoke body can be positioned closer to the permanent magnet constituting a part of the movable block, leakage of the magnetic flux can be minimized, allowing the contact driving structure to have an enhanced sensitivity. The electromagnetic drive according to the invention can thus be implemented in a much reduced size while assuring a high sensitivity. The known electromagnetic drive such as shown in FIG. 2 has an E-like yoke having a center core wound with a coil and a pair of lateral legs. In contrast, the yoke of the electromagnetic drive according to the invention has only two legs. This means that the lateral dimension or width of the electromagnetic drive apparatus can be reduced at least by a dimension corresponding to one leg.

In a preferred embodiment of the present invention, the iron core wound with the coil has an end portion provided with a pair of magnetically shielding plates of different thicknesses attached, respectively, to the lateral sides of the iron core so that the exposed surfaces of the shielding plates are located equidistant from the center axis of the iron core. With this structure, a so-called monostable type electromagnetic drive can be realized. In this structure, the movable block of the latching type electromagnetic drive can be equally used without requiring adjustment of the force of contact biasing springs or need for additional parts, whereby the latching type can be readily transformed to the monostable type relay and vice versa.

In a further embodiment of the present invention, the area over which one of the pole plates of the movable block is brought into contact with the iron core is selected smaller than the area over which the other pole plate is brought into contact with the core, whereby the monostable electromagnetic drive is realized. More specifically, in the case of the known polarized relay, the area over which the core contacts with either of the pole plates of the movable block remains constant. Accordingly, it is required to positively stabilize both the set and reset states of the polarized relay by overcoming the intrinsic resiliency of the movable contact bars. In contrast, according to one exemplary embodiment of the present invention, the contacting area between the iron core and the pole plate of the movable block is selected greater in the reset state than in the set state which is established through excitation of the coil wound on the core. Accordingly, the polarized relay is stabilized in the reset state in which the excitation of the coil is not effected. In this sense, this type structure may be referred to as the monostable relay. The difference in the contacting area between the set and the reset states can be readily accomplished by slightly modifying the relative positions of both the pole plates of the movable block relative to the iron core.

In a further embodiment of the present invention, the polarized electromagnetic relay apparatus in which a coil spool assembly is destined to be assembled on a terminal pin carrying base plate, comprises a coil spool having a pair of end collars, a flexible projecting piece formed in one of the collars and having a stopper, a supporting offset portion formed in the other collar, terminal members for the leads of the coil anchored in the other collar, a latch projection formed in the top surface of the base plate at a position near one end thereof and having a latch hole, a jaw like offset portion formed in the base plate at the other end opposite to aforementioned one end, wherein the coil spool assembly is fixedly mounted on the base plate through engagement of the flexible projecting piece with the latch hole and fitting of the jaw-like offset portion of the base plate onto the supporting offset portion of the spool. By virtue of this structure, the coil spool assembly can be offhand mounted fixedly on the base plate without requiring any other fixing or clamping members, while assuring a high precision positioning and inexpensive assembling.

The above and other objects, features and advantages of the present invention will be more apparent from the following description made by referring to the accompanying drawings.

BRIEF DESCRIPTION OF THE DRAWINGS

FIG. 9(*b*) is a side elevational view showing the electromagnetic drive apparatus shown in FIG. 9(*a*);

FIG. 11(*b*) is a view similar to FIG. 11(*a*) and shows the core structure for use in a latching type electromagnetic drive apparatus;

FIG. 12(*b*) is a view similar to FIG. 12(*a*) and shows the core structure for use in a latching type electromagnetic drive apparatus;

DESCRIPTION OF THE PREFERRED EMBODIMENTS

Now, the invention will be descrived in conjunction with an electromagnetic drive unit and a polarized electromagnetic relay which incorporates the electromagnetic drive apparatus according to exemplary embodiments of the present invention.

Figure 1:
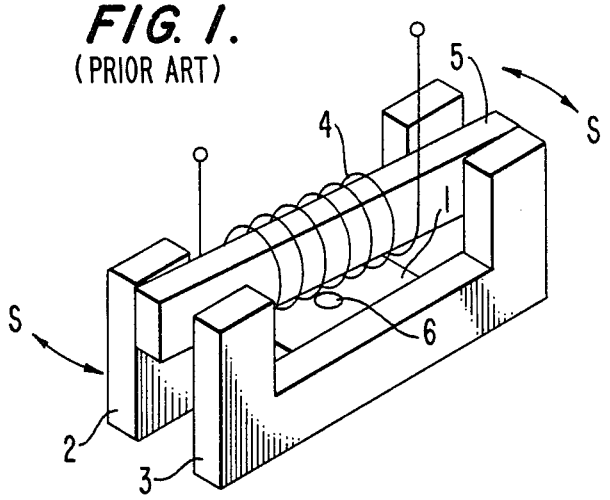
FIG. 1. (PRIOR ART)
FIG. 1 is a schematic perspective view showing a main portion of a known electromagnetic drive apparatus.
Figure 2:
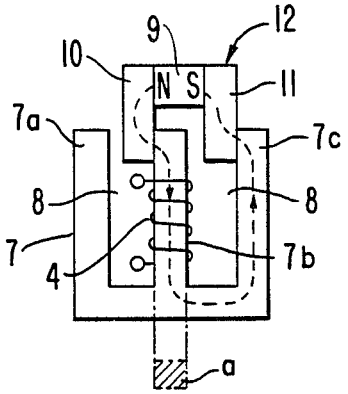
FIG. 2. (PRIOR ART)
FIG. 2 is a schematic top plan view of another known electromagnetic drive apparatus.
Figure 3:
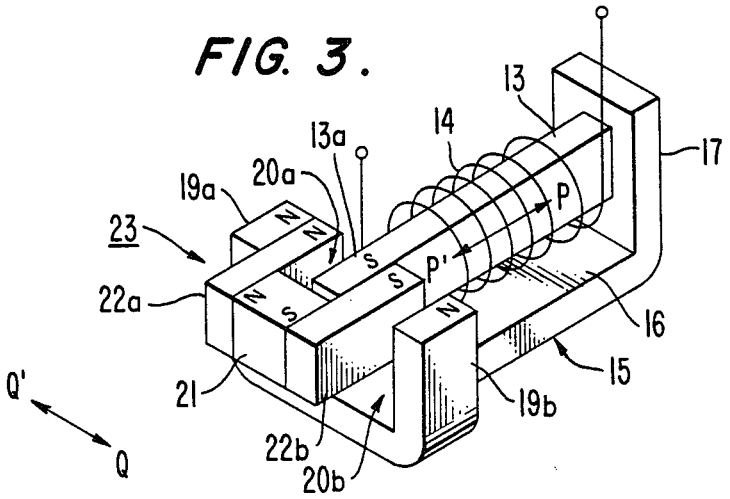
FIG. 3 is a schematic perspective view showing an electromagnetic drive apparatus according to a first embodiment of the present invention.
Figure 4:
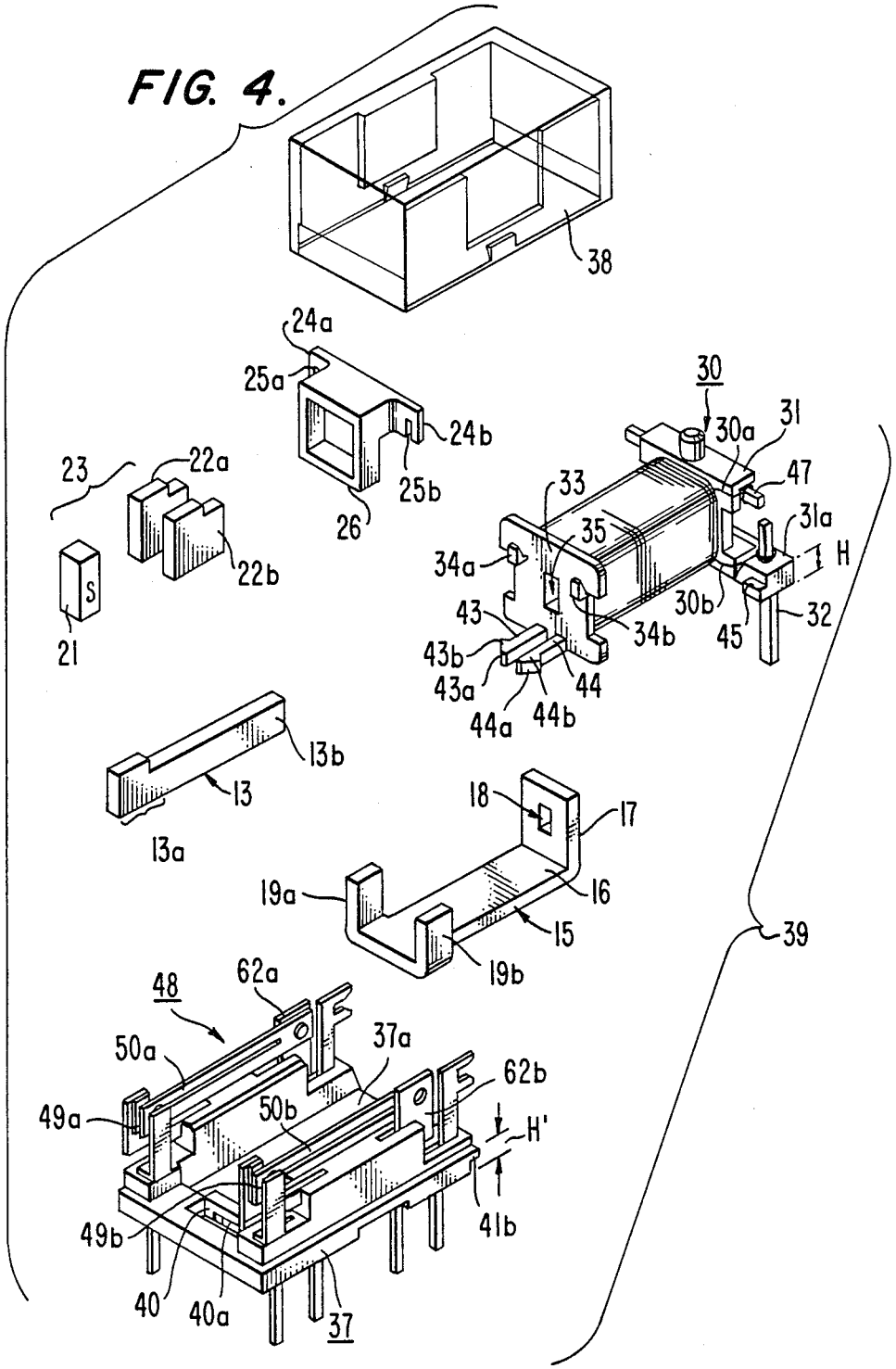
FIG. 4 is an exploded perspective view of a polarized relay incorporating the electromagnetic drive apparatus shown in FIG. 3.
Figure 5:
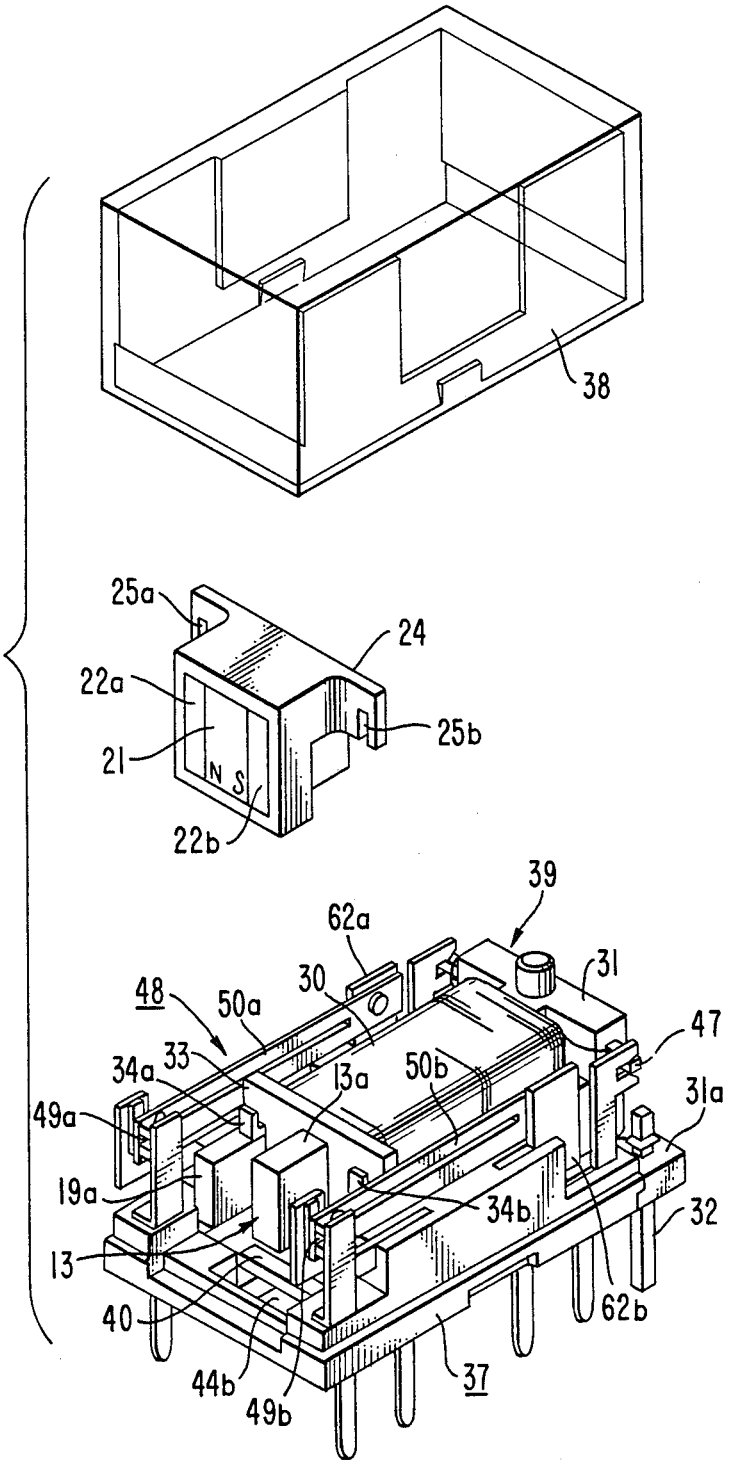
FIG. 5 is an exploded perspective view showing the polarized relay of FIG. 4 at an intermediate step of assembling.

FIGS. 3 to 5 show a first exemplary embodiment of the invention which concerns an improved electromagnetic drive unit or apparatus, a polarized electromagnetic relay incorporating the electromagnetic drive apparatus and a structure of the electromagnetic relay which allows the relay to be assembled in a facilitated manner. In this illustrated embodiment, the electromagnetic drive apparatus comprises an iron core 13, a yoke 15 constituted by a yoke body 16 extending in parallel with the iron core 13 and having a free end portion bifurcated so as to form a pair of oppositely facing upstanding ears or legs 19*a* and 19*b* with a predetermined distance therebetween, wherein the free end or head portion 13*a* of the bar-like iron core 13 is disposed between the legs 19*a* and 19*b* with air gaps 20*a* and 20*b* being defined at both sides, respectively. A movable block generally denoted by 23 which corresponds to the movable element 12 of the prior art electromagnetic drive shown in FIG. 2 is composed of a permanent magnet 21 sandwiched between a pair of magnetic side plates or pole pieces 22*a* and 22*b* in such an orientation in which the axis of magnetization of the permanent magnet 21 extends perpendicularly to the plates 22*a* and 22*b*. This movable block 23 is generally in a C-like configuration and so disposed that the legs of the movable block 23 constituted by the magnetic pole plates 22*a* and 22*b*, respectively, are positioned in the air gaps 20*a* and 20*b* slideably in the lateral directions as indicated by an double-headed arrow Q-Q'. A coil 14 is wound around the bar-like iron core 13. When the coil 14 is electrically energized in one direction, the core 13 is magnetized, whereby the movable block 23 is caused to move in the direction indicated by the arrow Q.

Referring to FIGS. 4 and 5, a reference numeral 30 generally indicates a bobbin or spool which is wound with the coil 14 and has a collar 31 at which a terminal post 32 is provided for leading out a coil conductor. A front collar 33 is provided with a pair of guide projections 34*a* and 34*b* at a same height, each of the guide projections being generally in an L-like configulation each having a upstanding vertical ear. A numeral 35 denotes a rectangular through-hole into which the bar-like iron core 13 having a head or free end portion 13*a* is inserted. In the state in which the bar-like iron core 13 is inserted into the bore 35 of the coil spool 30, the head portion 13*a* bears on the outer surface of the collar 33 and projects from the latter, while the other end portion denoted by 13*b* snugly fitted in a through-hole 18 formed in an upstanding wall 17 which is provided at the rear end of the yoke body 16 of the yoke 15, as viewed in FIG. 4. In this state, the yoke body 16 extends in parallel with the iron core bar 13 wound with the coil 14. In opposition to the end of the yoke body 16 at which the upstanding wall 17 is formed, there are formed a pair of the upstanding opposite pole plates 19*a* and 19*b* mentioned above which may be realized by bending upwardly the lateral arms of the generally T-like yoke body 16. The head or free end portion 13*a* of the bar-like iron core 13 is positioned at a center between the upstanding pole plates 19*a* and 19*b*, whereby air gaps or working gaps 20*a* and 20*b* are defined between the inner surface of the upstanding pole plate 19*a* and one side surface of the core end portion 13*a* on one hand and between the inner surface of the upstanding plate 19*b* and the other side surface of the end portion 13*a* on the other hand. As described hereinbefore, the movable block 23 is constituted by the permanent magnet 21 and the pair of magnetic side plates (pole pieces) 22*a* and 22*b* between which the permanent magnet 21 is disposed with the magnetization axis thereof extending perpendicularly to the plates 23*a* and 23*b*. The movable block 23 thus assembled is generally in a C-like configuration as from the above and held together by a frame-like holder generally denoted by 26 in such a manner in which lower portions of the magnetic side or pole plates 22*a* and 22*b* are exposed outwardly from the holder 26 towards the rear as shown in FIG. 5. The frame-like holder 26 has arms 24*a* and 24*b* formed at an upper end thereof and extending in lateral directions, respectively. These arms 24*a* and 24*b* have respective lower edges formed with notches 25*a* and 25*b*. When the arms 24*a* and 24*b* are slideably placed in the L-like guiding projections 34*a* and 34*b* of the front collar 33 of the coil spool 30 mentioned heretofore, the magnetic pole pieces 22*a* and 22*b* of the movable block 26 are movably positioned within the air gaps 22*a* and 22*b* defined between the core end portion 13 and the upstanding opposite magnetic plates 19*a* and 19*b*, respectively. In this state, movable contact plates or bars 50*a* and 50*b* of relay contact mechanisms 49*a* and 49*b* engage in the notches 25*a* and 25*b*, respectively, of the arms 24*a* and 24*b* of the holder frame 26. A reference numeral 38 denotes a cover which is on the relay structure generally designated by 39.

Next, description will be made of a manner in which the coil spool assembly 30 is combined with a terminal-pin carrying base plate 37 by also referring to FIGS. 6 and 7 in which several components such as the terminal-pins, cores and others are omitted from illustration for clarification of the drawings. The terminal-pin carrying base plate 37 has a top surface 37*a* on which an engaging projection 40 having a latch hole 40*a* is formed at a position closer to the front edge of the base plate 37, as viewed in FIGS. 5, 6, and 7. Although the latch hole or aperture 40*a* is of an elongated rectangular form in the case of the illustrated embodiment, the shape of the hole 40*a* may be modified as to comply with the configuration of flexible locking members 43 and 44 described hereinafter. The base plate 40 has a rear edge in which a pair of jaw-like offset portions 41*a* and 41*b* are formed at both sides, respectively, with a central offset portion 42 being formed between the lateral offset portions 41*a* and 41*b*. The front collar 33 has a pair of flexible or deformable projecting pieces 43 and 44 formed at the bottom end and projecting forwardly and in parallel with each other. The flexible projecting pieces 43 and 44 have respective free ends formed with slanted side surfaces 43*a* and 44*a* tapered towards the tips so as to define stopper surfaces 43*b* and 44*b*, respectively. On the other hand, the lower portion of the rear collar 31 is formed integrally with a terminal holder 31*a* in which supporting offset portions 45 are formed at both sides with a recess 46 being formed at a center bottom portion of the collar 31, as is clearly shown in FIG. 6.

Figure 6:
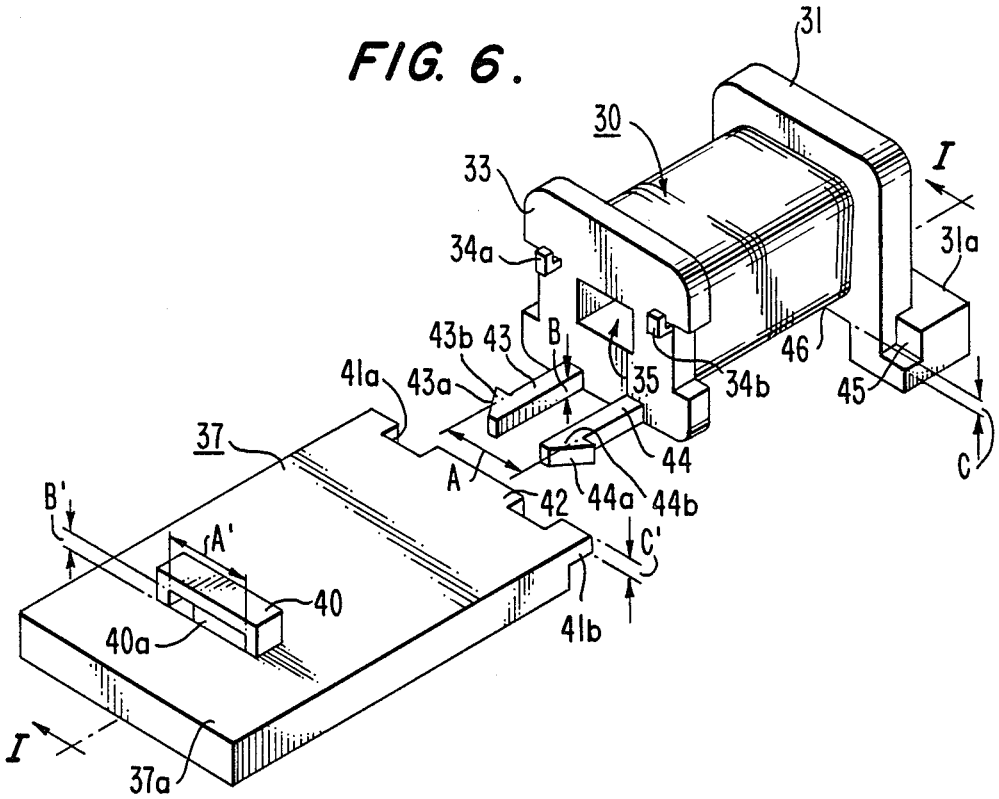
FIG. 6 is a perspective view for illustrating of a coil spool assembly on a terminal-pin carrying base plate upon assembling the polarized relay shown in FIG. 4, several parts being omitted from illustration for clarification thereof.
Figure 7:
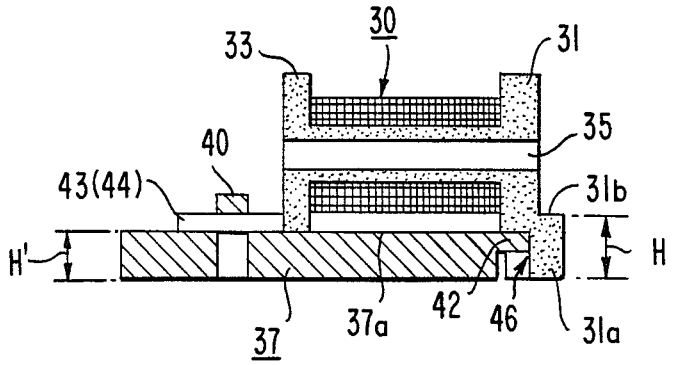
FIG. 7 is a side elevational view showing the polarized relay in the assembled state with several parts being omitted from illustration.

It is now assumed that a distance between the pair of the flexible projecting pieces 43 and 44 is represented by A, the thickness of which is represented by B, and that the width of the latch hole 40*a* of the engaging projection 40 is represented by A' with the height of the hole 40*a* being represented by B', as is shown in FIG. 6. Further, the distance between the level of the offset portion 45 and the top surface of the recess 46 is represented by C while the thickness of the jaw-like offset portion 41*a*, 41*b* is represented by C'. Then, these dimensions A, B, A', B', C and C' are so selected as to satisfy the following conditions:

$$A \leqq A'$$

$$B \leqq B'$$

$$C \geqq C'$$

On these conditions, the coil spool assembly 30 is assembled with the terminal-pin (post) carrying base plate 37 by moving the coil spool assembly 30 in sliding contact with the top surface 37*a* of the pin carrying base plate 30 so that the flexible projecting pieces 43 and 44 are inserted through the latch holes 40*a*, the jaw-like offset portions 41*a* and 41*b* are complementarily engaged with the supporting offset portions 45, respectively, and that the central projection 42 is fitted into the recess 46. It will be noted that when the flexible projecting pieces 43 and 44 are inserted into the latch hole 40*a*, the tapered surfaces 43*a* and 44*a* bear on both lateral inner surfaces of the engaging projection 40 to be resiliently deformed toward each other. After having passed through the hole 40*a*, the projecting pieces 43 and 44 are restored to the original state due to an intrinsic elastic restoring force. Then, the stoppers 43*a* and 43*b* snugly engage with the projection 40 to positively maintain the engaged states between the jaw-like offsets 41*a* and 41*b* and the supporting offsets 45 on one hand and between the center projection 42 and the recess 46 on the other hand, whereby the coil spool assembly 30 is integrally and fixedly combined with the terminal-pin carrying base plate 37. This assembling can be offhand accomplished through a single stroke of job in a much facilitated manner without fail. Additionally, the relative positioning of the coil spool assembly 30 and the base plate 37 can be attained with high precision. Reference numerals 32 and 47 denote terminal posts to which leads 30*a* and 30*b* of the coil wound on the spool are connected by soldering or the like. A reference numeral 48 generally denotes a contact mechanism comprising movable contacts and stationary contacts.

In the known electromagnetic relay apparatus, it is common that the coil terminal-pin or post is anchored in the terminal-pin carrying base plate 37. In contrast, in the case of the illustrated embodiment of the present invention, the coil terminal pin 47 is mounted on the terminal holder 31*a* formed integrally in the collar 31 of the coil spool assembly 30, the reason for which will be mentioned below. In the case where the coil terminal pin or post 37 is anchored in the base plate 37 as in the conventional electromagnetic relay, the coil lead 30*b* is allowed to be connected to the coil terminal pin 32 by soldering or the like only after the coil spool assembly 30 has been secured to the base plate 37. As the consequence, a delicate work of connecting the coil lead 30*b* to the terminal pin or post 32 by soldering must be performed in a much restricted or narrow space, giving rise to a problem or difficulty concerning the assembling of the relay apparatus, particularly in connecting the lead to the terminal. On the contrary, in the case of the illustrated embodiment of the invention, since the coil terminal pin 32 is mounted on the terminal holder 31 formed in the collar 31 of the spool 30, soldering of the coil lead to the terminal 32 can be carried out before the coil spool assembly 30 is mounted on the base plate 37. Thus, the connection of the coil lead to the associated terminal pin can be realized very easily because relatively large space is available for the soldering.

Additionally, the anchoring of the coil terminal pin 32 in the terminal holder 31*a* increases the rigidity of the mounted terminal pin 32. This will be explained below. It is assumed that the thickness of the terminal-pin carrying base plate 37 is represented by H' while that of the terminal holder 31*a* is represented by H. Then, the rigidity can be assured by selecting the dimensional relationship such that $H > H'$. The reason will be clearly seen from FIG. 7. Since the top surface 31*b* of the terminal holder 31*a* must be higher than the top surface 37*a* of the base plate 37 in order that the center projection 42 can be fitted in the recess 46, the condition that $H > H'$ can be readily realized. It is then apparent that the rigidity of the coil terminal pin 32 anchored in the terminal holder portion 31*a*, of a greater thickness H is enhanced when compared with the coil terminal pin anchored in the base plate of a smaller thickness H'.

In the latching type electromagnetic relay apparatus of the structure described above, the free end or head portion 13*a* of the core 13 is polarized in the south (S) polarity when the core 13 is magnetized in the direction indicated by the arrow P by supplying the current to the coil 14 in the corresponding direction, whereupon the bifurcated opposite pole plates 19*a* and 19*b* of the yoke 15 are polarized in north (N) polarity, resulting in that the movable block 23 is moved in the direction indicated by the arrow Q, as is shown in FIG. 3. It will be readily understood that the lateral movement of the block 23 is accompanied by the movement of the movable contacts 50*a* and 50*b* to make or break the circuit with the stationary contacts 49*a* and 49*b*.

Figure 8:
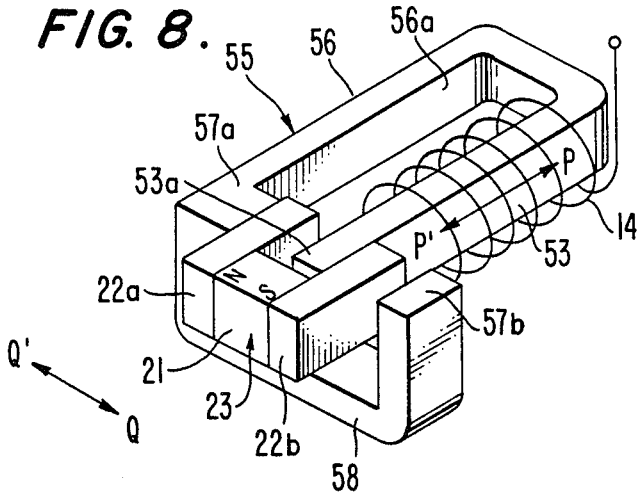
FIG. 8 is a schematic perspective view showing an electromagnetic drive apparatus according to a second embodiment of the invention.

FIG. 8 shows a second embodiment of the present invention. In the case of the latching type electromagnetic drive apparatus according to this second embodiment, a bar-like core 53 wound with a coil 14 is formed integrally with a yoke body 56 to constitute a yoke generally designated by 55 in which the core 7 is juxtaposed in parallel with the yoke body 56. The other end portion of the yoke body 56 is bifurcated into a pair of oppositely facing pole plates 57*a* and 57*b* with a distance therebetween which is large enough to accommodate the head or end portion 53*a* of the core 53. The opposite pole plates 57*a* and 57*b* are intergrally connected to each other by a connecting web 58 extending below the core end portion 53*a*. The inner surface or wall 56*a* of the yoke body 56 is retracted from the end face of the pole plate 57*a* so as to make available a space for accommodating the coil 14 even of a large diameter. A reference numeral 23 generally denotes a movable block constituted by a permanent magnet 21 and a pair of pole plates or pieces 22*a* and 22*b* between which the permanent magnet 21 is fixedly mounted in the end abutting relation in a general C-like configuration. The pole pieces 22*a* and 22*b* are laterally movably disposed within air gaps (working gap) defined between the core end portion 53*a* and the oppositely facing pole plates or legs 57*a* and 57*b*, respectively. The movable block 23 is secured in a holder frame 26 to which the movable contact plates 50*a* and 50*b* of the contacts 49*a* and 49*b* described hereinbefore in conjunction with the first embodiment are connected so that the contacts 49*a* and 49*b* are opened or closed upon movement of the movable block 23. When the coil 14 is excited in the direction indicated by an arrow P in the state of the movable block 23 shown in FIG. 8, the core head or end portion 53*a* is magnetized with the south (S) polarity while the oppositely facing plates 57*a* and 57*b* are magnetized in the north (N) polarity. Thus, the movable block 23 is caused to move in the direction indicated by an arrow Q, resulting in that the pole piece 22*b* being attracted to the plate 57*b* with the pole piece 22*a* being attracted to the core end portion 53*a*. Starting from this state, energization of the coil 14 in the direction indicated by an arrow P' causes the movable block 23 to be moved in the direction indicated by an arrow Q' to be reset to the original position shown in FIG. 8.

Figure 9A:
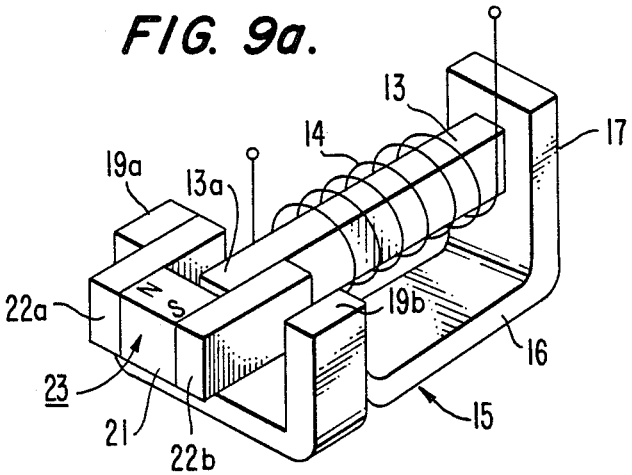
FIG. 9(*a*) is a schematic perspective view showing an electromagnetic drive apparatus according to a third embodiment of the invention.
Figure 9B:
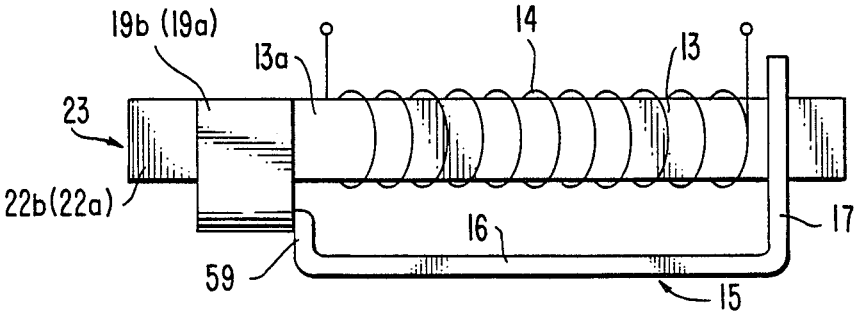

FIG. 9 shows an electromagnetic drive apparatus of latching type according to a third exemplary embodiment of the present invention. The structure of the electromagnetic drive shown in FIG. 9 is basically identical with that of the electromagnetic apparatus shown in FIG. 3 except that the connecting web of the oppositely disposed pole plates 19*a* and 19*b* is connected to the yoke body 16 through an offset portion 59, as shown in FIG. 9(*b*). This structure is effective to prevent the coil 14 of a large diameter wound on the bar-like iron core 13 from interfering with the yoke body 16.

Figure 10:
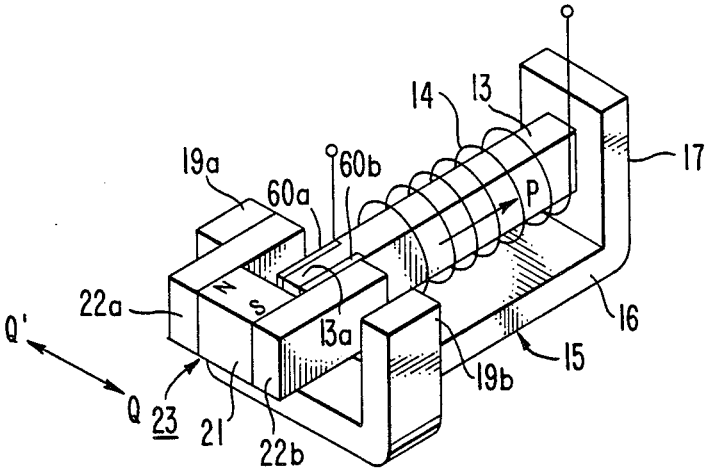
FIG. 10 is a schematic perspective view showing an electromagnetic drive apparatus according to a fourth embodiment of the present invention.
Figure 11A:
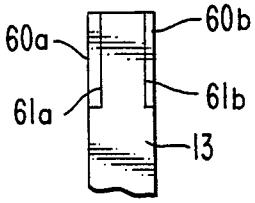
FIG. 11(*a*) is a view showing a structure of a free end portion of an iron core to be used in a monostable type electromagnetic drive apparatus according to the fourth embodiment.
Figure 11B:
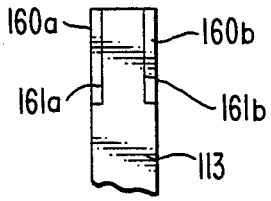
Figure 12A:
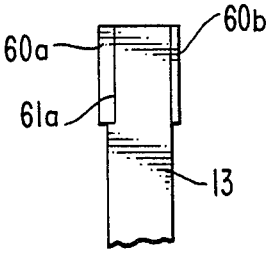
FIG. 12(*a*) is a view illustrating a structure of a free end portion of an iron core to be used in a monostable type electromagnetic drive apparatus according to the fourth embodiment.
Figure 12B:
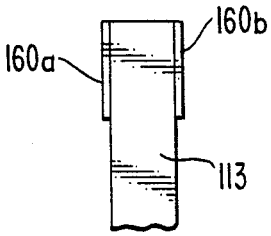
Figure 13:
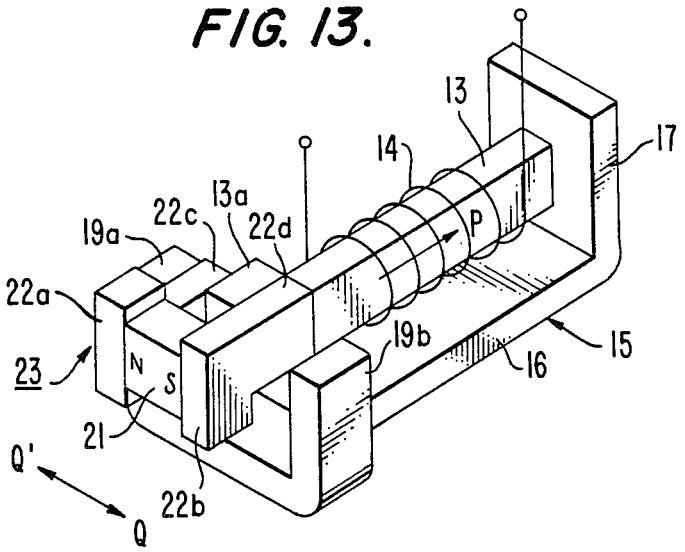
FIG. 13 is a schematic perspective view showing an electromagnetic drive apparatus according to a fifth embodiment of the present invention.
Figure 14:
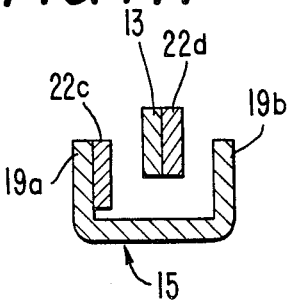
FIG. 14 is a view for illustrating a contacting state of an iron core and one pole plate of a movable block in the reset state of the electromagnetic drive apparatus shown in FIG. 13.
Figure 15:
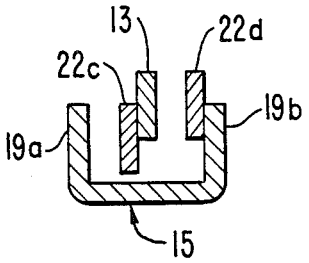
FIG. 15 is a view showing a contacting state of an iron core and the other pole plate of the movable block in the set state of the electromagnetic drive apparatus shown in FIG. 13.

FIGS. 10 to 12 shows a fourth embodiment of the present invention. Although the electromagnetic drive apparatus according to the instant embodiment is basically of the same structure as that of the first embodiment, the former differs from the latter in that a pair of magnetically shielding plates 60*a* and 60*b* are mounted on the head or end portion of the core 13 at both sides in opposition to each other, the core 13 being wound with a coil 14. In this connection, it is to be noted that the magnetically shielding plate 60*a* is thicker than the other plate 60*a*, and both plates are press-fitted in recesses 61*a* and 61*b* formed in the core 13 so that the exposed surfaces of both shield plates 60*a* and 60*b* are located equidistant from the center axis of the core 13, as is shown in FIG. 11(*a*). This core structure is employed in the monostable type relay, as described hereinafter. Such press-fitting can be easily practiced in view of the fact that the magnetically shielding plate is usually of stainless steel while the core is generally of soft iron. On the other hand, FIG. 11(*b*) shows a latching type core structure 113 in which magnetically shielding plates 160*a* and 160*b* of a substantially equal thickness are press-fitted in the recesses 161*a* and 161*b*, respectively. Accordingly, when the magnetically shielding plates 160*a* and 160*b* of different thickness are press-fitted in the recesses 161*a* and 161*b* of the iron core 113 destined to be used in the latching or bistable type electromagnetic drive apparatus, the latter is converted to the monostable electromagnetic drive.

The securing of the magnetically shielding plates 60*a* and 60*b* may be realised by bonding in place of the press-fitting. In a version shown in FIG. 12(*a*), a recess 61*a* is formed only in one side surface of the iron core 13. By mounting the magnetically shielding plate 61*a* in the recess 61*a* with the other shielding plate 60*b* being bonded or welded to the other flat side surface of the core 13, the exposed surface of both the shielding plates 60*a* and 60*b* can be positioned equidistant from the center axis of the iron core 13. Referring to FIG. 12(*b*), there is shown a structure of the iron core 113 used for a latching type electromagnetic drive apparatus in which the shielding plates 160*a* and 160*b* both of equal thickness are bonded to the flat side surfaces of the core 113, respectively.

The structure and the action of the movable block 23 are equivalent to those of the preceding embodiments.

In the electromagnetic drive of the structure described just above, excitation of the coil 14 in the direction indicated by an arrow P causes the free end (or head) portion of the bar-like iron core 13 to be polarized in S polarity and the oppositely facing pole plates 19*a* and 19*b* located at the bifurcated ends of the yoke body 16 are magnetized in N polarity. Since the free end portions of the magnetic pole pieces 22*a* and 22*b* of the movable block are magnetized in N and S polarities, respectively, under the action of the permanent magnet 21, the movable block 23 is translated in the direction indicated by an arrow Q under attracting and repulsing forces exerted to the magnetic pieces 19*a* and 19*b*. At that time, the movable contact plates linked to the movable block 23 are operated to close normally opened contacts.

Upon deenergization of the coil 14, the movable block 23 is caused to move in the direction indicated by an arrow Q' under the intrinsic restoring force of the movable contact plate or bar linked to the block 23 as well as under the influence of unbalanced magnetic action ascribable to the difference in thickness between the shielding plates 60*a* and 60*b*, resulting in that the normally closed contacts are closed. At that time, a magnetic circuit is formed which extends from the N pole of the permanent magnet 21 through the plate 19*a*, the yoke body 16, the iron core 13, the shielding plate 60*b* and the pole piece 22*b* to the S-pole of the permanent magnet 21, whereby the electromagnet drive is stabilized in this reset state. In other words, this electromagnetic drive performs a so-called monostable operation.

FIGS. 13 to 17 show an electromagnetic drive apparatus according to a fifth exemplary embodiment of the present invention. The basic structure of this electromagnetic drive is substantially identical with that of the first embodiment described hereinbefore. Referring to FIGS. 13 to 16, a coil 14 is wound on a spool 30 which has an iron core 13 inserted into a center bore 35 to be thereby combined integrally with a yoke 15. The structure and operation of the movable block 23 is basically same as those of the preceding embodiments. Accordingly, repeated description will be unnecessary.

Figure 16:
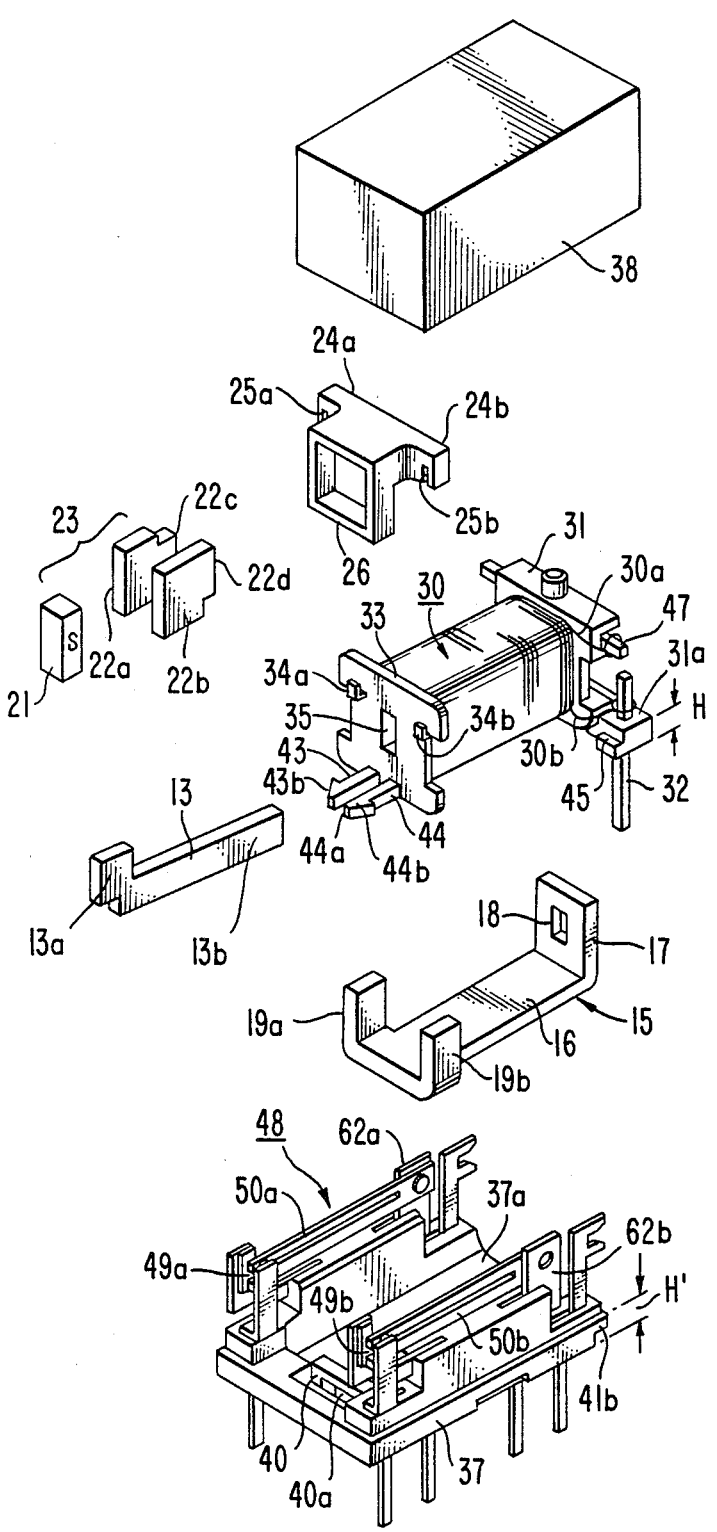
FIG. 16 is an exploded perspective view showing a polarized relay incorporating the electromagnetic drive apparatus shown in FIG. 13.

Referring to FIG. 16 in particular, the yoke 15 is installed on a terminal-pin carrying base plate 37 having mechanical contact switches 49*a* and 49*b* mounted at both sides, respectively. The movable block 23 is mounted movably in the directions indicated by a double-headed arrow Q-Q' in such an arrangement in which projections 22c and 22d of the pole pieces 22a and 22b are disposed within air gaps defined between the iron core 13 of the yoke 15 and the oppositely facing plates 19a of the yoke body 16, respectively. The projections 22c and 22d of the pole pieces 22a and 22b are positioned at different heights so that the area over which the projection 22c is brought into contact with the pole plate 19a is greater than the area over which the projection 22d contacts with the other plate 19b.

The contacts 49a and 49b have respective movable contact bars 50a and 50b which are secured to terminal posts 62a and 62b, respectively, at rear ends thereof. The movable contacts constitute, respectively, normally closed contacts and normally opened contacts in cooperation with counterpart fixed contacts. The movable contact bars 50a and 50b are engaged in notches 25a and 25b formed in arms 24a and 24b of the holder frame 26 and imparted with an elastic restoring force so that the movable contact bars are biased to the normally closed position.

With the above mentioned structure of the electromagnetic relay, the movable block 23 is displaced in the direction indicated by the arrow head Q' (FIG. 13) under the intrinsic resilient restoring force of the movable contact bars 50a and 50b in the deenergized state of the magnet coil, whereby the closed magnetic path is formed which extends from the N-pole of the permanent magnet 21, through the pole piece 22a, the plate 19a, the core 13 and the plate 19b to the S-pole of the permanent magnet 21, to maintain the movable contacts at the normally closed position. In this state, the movable block 23 is stable (refer to FIG. 14).

Starting from the above mentioned state, excitation or energization of the coil 14 in the direction indicated by the arrow P brings about appearance of S-polarity in the core head (free end) portion 13a of the yoke 15 while the end portions of the opposite plates 19a and 19b are magnetized in N-polarity, as the result of which the movable block 23 is caused to move in the direction indicated by the arrow Q (FIG. 13) to thereby change over the movable contacts from the normally closed position to the normally opened position. Upon removal of the energization, the intrinsic spring force (restoring force) exerted by the movable contact bars or leaves 50a and 50b overcomes the magnetic force of the magnetic path which extends from the N-pole of the permanent magnet 21 through the pole piece 22a, the core 13, the plate 19b and the pole piece 22b to the S-pole of the magnet 21. Consequently, the movable block 23 is restored to the starting position under the restoring spring force, as indicated by the arrow Q'. In this way, the electromagnetic relay performs a so-called monostable switching operation. The reason why the restoring spring force can overcome the magnetic force of the above mentioned magnetic circuit can be explained by the fact that the contacting areas between the pole pieces 22a and the core 13 and between the pole piece 22b and the plate 19b are reduced, as described hereinbefore.

Figure 17:
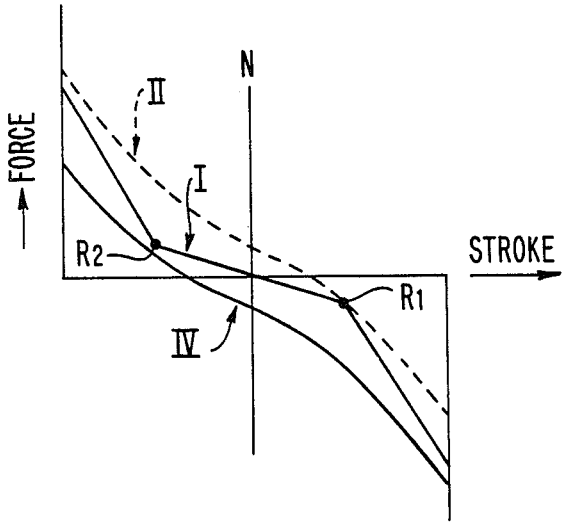
FIG. 17 is a view for graphically illustrating operation characteristics of the polarized relay shown in FIG. 16.

Operation characteristics of an electromagnetic drive according to the invention are graphically illustrated in FIG. 17, in which the stroke of the movable block 23 is taken along the abscissa, while external force applied to the movable block as it moves is taken along the ordinate. In FIG. 17, a curve I represents load characteristics, a curve II represents attraction characteristics upon excitation of the coil and a curve IV represents attraction characteristic of the permanent magnet 21. Further, $R_1$ and $R_2$ represent the points at which the movable contacts are brought into contact with the respective stationary contacts.

The invention has been described in conjunction with several exemplary embodiments. It will however be appreciated that many modifications and variations readily occur to those skilled in the art without depertting from the scope and spirit of the invention. By way of example, the movable block 23 may be so constituted as to perform rotational movement instead of the linear displacement.

We claim:

1. An electromagnetic drive apparatus comprising:

electromagnetic yoke comprising a core and a yoke body, said yoke body having a central portion substantially parallel to said core, a first leg disposed at a first end of said central portion and second and third legs disposed at a second end of said central portion, said second and third legs extending substantially perpendicular to said central portion, wherein said second and third legs are of substantially smaller dimensions than said central portion;

means disposed around said core for inducing a first magnetic polarity in said first leg and a second magnetic polarity, opposite said first magnetic polarity, in said second and third legs;

a pair of working gaps being defined between a first end of said core and each of said second and third legs, respectively; and a movable block provided at said first end of said core comprising a permanent magnet in a generally C-like configuration said permanent magnet being parallel to said first leg and forward of said core, and having two magnetic poles parallel to said core and extending rewardly toward said first leg and disposed within said working gaps, respectively, said magnetic poles being movable within said working gaps.

2. An electromagnetic drive apparatus according to claim 1, wherein said core and said yoke body are vertically so positioned that longitudinal axes therof extend substantially in parallel with each other.

3. An electromagnetic drive apparatus according to claim 1, wherein said core and said yoke body are horizontally so positioned that longitudinal axes thereof extend substantially in parallel with each other.

4. An electromagnetic drive apparatus according to claim 2, wherein said second and third legs are connected to said yoke through an offset portion.

5. An electromagnetic drive apparatus according to claim 1, further comprising a pair of magnetically shielding plates of thicknesses differing from each other mounted on said first end of said core such that exposed surfaces of said shielding plates are positioned equidistant from a center axis of said core.

6. An electromagnetic drive apparatus according to claim 1, wherein a first area over which a magnetic pole of said movable block is brought into contact with one of said second and third legs upon actuation of said movable block is smaller than a second area over which the other magnetic pole of said movable block is brought into contact with the other of said second and third legs upon restoring of said movable block.

7. The electromagnetic drive apparatus according to claim 1, wherein said means for inducing is a coil.

8. An electromagnetic drive apparatus according to claim 1 wherein said permanent magnetic and said two magnetic poles have upper surfaces substantially coextensive with a top surface of said core and of said second and third legs.

9. A polarized electromagnetic relay apparatus comprising:

an electromagnetic yoke comprising a core and a yoke body, said yoke body having a central portion substantially parallel to said core, a first leg disposed at a first end of said central portion and second and third legs disposed at a second end of said central portion, said second and third legs extending substantially perpendicular to said central portion, wherein said second and third legs are of substantially smaller dimensions than said central portion;

means disposed around said core for inducing a first magnetic polarity in said first leg and a second magnetic polarity, opposite said first magnetic polarity, in said second and third legs;

said second and third legs being separated by a first end of said core so as to define a pair of working gaps therebetween;

a movable block provided at said first end of said core comprising a permanent magnet in a generally C-like configuration said permanent magnet being parallel to said first leg and forward of said core, and having two magnetic pole pieces parallel to said core and extending rewardly toward said first leg and disposed within said working gaps, respectively;

guiding means for guiding movement of said movable block so that said pole pieces are movable within said working gaps, respectively; and a contact mechanism having movable contacts mechanically coupled to said movable block.

10. A polarized electromagnetic relay apparatus according to claim 9, further comprising a pair of magnetically shielding plates of thicknesses differing from each other mounted on said first end of said core at both sides thereof such that exposed surfaces of said shielding plates are positioned equidistant from a center axis of said core.

11. A polarized electromagnetic relay apparatus according to claim 9, wherein a first area over which a magnetic pole of said movable block is brought into contact with one of said second and third legs upon actuation of said movable block is selected smaller than a second area over which the other magnetic pole of said movable block is brought into contact with the other of said second and third legs upon restoring of said movable block.

12. The electromagnetic drive apparatus according to claim 9, wherein said means for inducing is a coil.

* * * * *